United States Patent [19]

Mueller

[11] 4,421,551

[45] Dec. 20, 1983

[54] PROCESS FOR PREPARING ROTUND PARTICLES OF SALT-COATED MAGNESIUM OR MAGNESIUM ALLOY

[75] Inventor: Udo Mueller, Stavern, Norway

[73] Assignee: Norsk Hydro a.s., Oslo, Norway

[21] Appl. No.: 344,059

[22] Filed: Jan. 29, 1982

[30] Foreign Application Priority Data

Feb. 5, 1981 [NO] Norway ..... 810385

[51] Int. Cl.[3] ..... C22C 1/04

[52] U.S. Cl. ..... 75/0.5 B; 264/7; 264/8

[58] Field of Search ..... 75/0.5 B, 0.5 R; 264/7, 264/8

[56] References Cited

U.S. PATENT DOCUMENTS 4,186,000 1/1980 Skach, Jr. et al. ..... 75/0.5 B 4,279,641 7/1981 Skach, Jr. et al. ..... 75/0.5 B 4,331,711 5/1982 Skach, Jr. et al. ..... 75/0.5 B

*Primary Examiner*—W. Stallard

*Attorney, Agent, or Firm*—Wenderoth, Lind & Ponack

[57] ABSTRACT

Process for preparing rotund particles of salt-coated magnesium or magnesium alloy, by adding molten magnesium or magnesium alloy to a substantially non-hygroscopic salt melt having a viscosity of from 1.5 to 5.0 cps containing at least 50% by weight of anhydrous alkali metal chloride, and having a density substantially the same as the density of the molten metal, stirring the molten metal and salt melt at a certain speed and temperature to obtain a dispersion of the molten metal in the salt melt containing up to 60% by weight of the molten metal, cooling the dispersion and disintegrating the resultant solid product.

21 Claims, No Drawings

PROCESS FOR PREPARING ROTUND PARTICLES OF SALT-COATED MAGNESIUM OR MAGNESIUM ALLOY

BACKGROUND OF THE INVENTION

The present invention relates to a process for preparing rotund particles of salt-coated magnesium or magnesium alloy. The salt coating acts as a protective coating for the magnesium or magnesium alloy, i.e. protection against, for example, oxygen and moisture.

Such salt-coated metal particles as described above are suitable for use as, for example, a desulphurizing agent in the iron and steel industry, a nodularizing agent for producing ductile iron, and an alloying element with aluminum. For these purposes, the salt-coated metal particles are added to a molten metal through a lance by means of a carrier gas.

In order to ensure reliable feeding of the particles, and also prevent blockage of the lance, it is desirable that the coated metal particles have as uniform a size and shape as possible.

As is known, magnesium is an easily oxidized metal, and in finely divided form it can be pyrophoric. Also, in contact with water, magnesium can generate hydrogen. These factors result in explosion and fire hazards in the production, transport and handling of particles of magnesium or magnesium alloys.

For these reasons, it has been a normal practice, in the production of magnesium or magnesium alloy particles, for example, by centrifuging liquid metal by means of a rotating disc or perforated cup, to carry out the process in an inert atmosphere. In addition to being expensive, as a result of the requirements for an inert gas and relatively complicated apparatus, this process is not entirely satisfactory with regard to avoiding the hazard of explosion. Furthermore, in such prior art processes, there is an inability to adequately control the particle size of the particles, and also, a high amount of dust is usually generated.

U.S. Pat. No. 3,881,913 discloses a process for preparing a magnesium-containing mixture, by centrifuging molten metal during simultaneous addition of a salt mixture having a lower melting point than the melting point of the magnesium. This process is carried out in air, and the salt mixture contains alkali metal chlorides and fluorides, magnesium chloride and alkaline earth metal chlorides. The product resulting from this process is a mixture of salt-coated magnesium granules having a spherical and/or eliptical shape, and granules of the salt itself. The process has the disadvantages of insufficient control of the shape and size of the produced particles, variable thickness of the salt coating on the metal particles, and the failure to eliminate the danger of the magnesium catching fire during centrifuging.

U.S. Pat. No. 4,186,000, and U.S. Pat. No. 4,279,641, the latter being a continuation-in-part of the former, disclose a process for recovering rotund, salt-coated magnesium particles entrapped in friable matrix of sludge or slag (dross) material from magnesium electrolysis cells or holding furnaces. The process of U.S. Pat. No. 4,186,000 is based on the addition of a boron-containing dispersant to the molten matrix consisting of a mixture of electrolyte salts, magnesium metal, magnesium oxide and some impurities, stirring the mixture to achieve dispersion, followed by cooling to freeze the mixture, disintegration of the frozen mixture, and screening off the salt-coated magnesium particles. In this process, boron is used as a surface-stabilizing agent to prevent coalescence of the dispersed magnesium particles. U.S. Pat. No. 4,279,641 indicates that the use of the boron, or other dispersing aid, is optional. However, in this instance, it is necessary to keep the alkali metal chloride in the salt mixture to at least about 46%, preferably at least about 50%, and to employ salt mixtures which have a eutectic melting point at or below the melting point of magnesium, in order that the magnesium granules freeze first when the mixture is cool. Certain other requirements for the composition of the salt mixture must also be met in the event no dispersing aid is employed.

Additionally, in both U.S. Pat. No. 4,186,000 and U.S. Pat. No. 4,279,641, the stirrer used to form the dispersion of the magnesium in the salt melt is operated at a tip speed of about 1,500 to about 4,000 feet per minute, i.e. about 457 to about 1,220 meters per minute. These high stirring speeds are necessary as a result of the high viscosity of the mixtures formed in these processes. These high stirring speeds, of course, mean a relatively high energy consumption to achieve dispersion of the metal in the salt melt.

In order to improve the economics of the process, additional metal is added to the salt mixture, since the initial amount of magnesium in the sludge matrix is normally less than 15% by weight. The maximum amount of magnesium dispersed in the mixture is limited to a maximum of about 42% by weight, and is preferably held to a maximum of about 38–40% by weight. Amounts of magnesium above these limits result in formation of clusters of metal beads adhered to, or coalesced with, each other when cooled, so-called "off-spec" metal.

Furthermore, in both of these processes, the electrolyte salt mixture employed, which contains both alkali metal halogenides and alkaline earth metal halogenides, is hygroscopic, and this makes it necessary to control the relative humidity during handling of the granules to less than 35%, preferably less than 20%.

Thus, it is apparent that there are several disadvantages associated with prior art processes for preparing rotund particles of salt-coated magnesium or magnesium alloy.

SUMMARY OF THE INVENTION

The object of the present invention is an improved process for preparing particles of salt-coated magnesium or magnesium alloy which avoids the disadvantages associated with the prior art processes in connection with the preparation, handling and/or use of such particles.

A more specific object of the present invention is to prepare rotund particles of salt-coated magnesium or magnesium alloy without using any special surface-stabilizing agent or surface-active agent. Another object of the invention is to reduce the energy consumption below that required by prior art processes for producing rotund particles of salt-coated magnesium or magnesium alloy.

A further object of the invention is to prepare rotund particles of salt-coated magnesium or magnesium alloy without the necessity for special requirements of controlling the humidity in the atmosphere, or instituting safety precautions during the preparation, handling and use of the produced particles.

These and other objects are achieved in accordance with the present invention, by a process for preparing rotund particles of salt-coated magnesium or magnesium alloy, which comprises adding a molten metal selected from the group consisting of magnesium and a magnesium alloy to a substantially non-hygroscopic salt melt, having a viscosity of from 1.5 to 5.0 cps containing at least 50% by weight of at least one anhydrous alkali metal chloride, the density of said salt melt being substantially the same as the density of said molten metal; stirring said molten metal and salt melt with a stirrer operating at a tip speed always below 450 meters per minute, at a temperature of from 660° to 730° C., to obtain a dispersion of said molten metal in said salt melt containing up to 60% by weight of said molten metal; cooling said dispersion to solidify the molten metal and salt melt; and disintegrating the resultant solid product to obtain rotund particles of said salt-coated magnesium or magnesium alloy.

DETAILED DESCRIPTION OF THE INVENTION

In accordance with the present invention, it has been found that by employing a special combination of process parameters for dispersing the molten metal in the salt melt, and by employing a certain composition for the salt melt, it is possible to prepare rotund particles of salt-coated magnesium or magnesium alloy, hereinafter sometimes referred to simply as "rotund salt-coated metal particles". These particles can be directly prepared from the present invention within a specified range for the grain size for the particles, without the addition of any special surface-stabilizing or surface-active agent.

Another particular advantage of the present invention over the prior art is that the amount of molten metal in the dispersion can be as high as 60% by weight, for example, from 40 to 60% by weight, preferably from 45 to 55% by weight, based on the weight of the dispersion. These amounts can be achieved without coalescence of the formed particles, or the necessity to stop the dispersion process.

The process of the present invention is based on the dispersion of the molten metal, by mechanical means, in a salt melt of a certain composition, followed by cooling the dispersion to solidify the molten metal and salt melt, and then disintegrating the solid product thus produced to obtain the rotund salt-coated metal particles. These particles can then be screened from the salt mass.

The salt melt employed in the present invention must meet certain requirements, i.e. it must be substantially non-hygroscopic, it must have a certain viscosity, it must contain at least 50% by weight of at least one anhydrous alkali metal chloride, and it must have a density substantially the same as the density of the molten metal.

The term "substantially non-hygroscopic" as applied to the salt melt means that the salt melt will be non-hygroscopic at a relative humidity of 60%.

A mixture of pure sodium chloride and potassium chloride is non-hygroscopic up to about 72% relative humidity. Small amounts of impurities or other chlorides, for example, magnesium chloride, will reduce the value for the relative humidity at which the mixture will remain non-hygroscopic. The 72% value can be reduced down to 60%, and the salt melt will still be suitable for use in the process of the present invention.

For example, if the salt melt begins to absorb moisture when the relative humidity is only 55%, then the salt melt can not be used in the present invention, since it is not sufficiently non-hygroscopic, i.e. it is not "substantially non-hygroscopic" as this term is employed in the present specification and claims. On the other hand, if the salt melt does not begin to absorb moisture until the relative humidity is higher than 60%, then the salt melt is suitable for use in the present invention.

The viscosity of the salt melt is from 1.5 to 5.0 cps (centipoises), preferably from 1.6 to 3.0 cps.

The actual viscosity of a pure equimolar mixture of sodium chloride and potassium chloride is 2.5 cps at 658° C., and 1.6 cps at 744° C. The viscosity of the salt melt is a function of the impurities, for example, magnesium oxide. A higher content of magnesium oxide will increase the viscosity of the salt melt.

As long as the viscosity of the salt melt is within the range of from 1.5 to 5.0 cps at the temperature at which the dispersion of the molten metal in the salt melt is formed, the salt melt will have a viscosity suitable for the present invention.

The salt melt must contain at least 50% by weight of at least one anhydrous alkali metal chloride, i.e. an alkali metal chloride without any water of crystallization. Examples of the anhydrous alkali metal chloride are sodium chloride, potassium chloride and lithium chloride. The alkali metal chlorides can be used singly, or as mixtures of two or more of them.

The density of the salt melt must be substantially the same as the density of the molten metal.

Any salt melt which satisifies these requirements can be employed in the present invention. Examples of such salt melts are mixtures of from 40 to 50% by weight of sodium chloride and from 50 to 60% by weight of potassium chloride, possibly containing small amounts of other materials for adjustment of the density of the mixture to the desired density. Also, substantially the same density for the salt melt and the molten metal can be achieved by using alloys of magnesium with other metals, for example, aluminum and/or zinc.

An equimolar mixture of sodium chloride and potassium chloride gives a salt melt having a density of from 1.575 to 1.61 g/cm$^3$ at a temperature of from 700° to 660° C., compared to a density of from 1.58 to 1.60 g/cm$^3$ for pure magnesium. This means that during the dispersion of the molten metal in the salt melt, the particles formed are in equilibrium with the surrounding melt, and are influenced by no force other than the hydrostatic pressure.

The molten metal employed in the present invention is substantially pure magnesium, or a magnesium alloy. Any magnesium alloy can be employed. An example of a magnesium alloy is an alloy consisting essentially of about 96% by weight of magnesium, about 3% by weight of aluminum and about 1% by weight of zinc.

After adding the molten metal to the substantially non-hygroscopic salt melt, stirring is conducted with a stirrer operating at a tip speed (speed on periphery of the blades of the stirrer) below 450 meters per minute, preferably below 400 meters per minute, at a temperature of from 660° to 730° C., preferably from 660° to 710° C., more preferably from 690° to 710° C., to obtain the dispersion of the molten metal in the salt melt.

Preferably, stirring is conducted for from 0.5 to 20 minutes.

The type of stirrer employed in the process of the present invention can be any stirrer which will give the desired dispersion. Examples of the stirrer are a turbine stirrer and a straight-blade stirrer. Especially preferred is stirring with a turbine stirrer operating at a tip speed of from 100 to 400 meters per minute for from 1 to 15 minutes.

By varying the speed of the stirrer and the stirring time, the particle size range for the produced particles can be regulated. For example, particles having a range from 0.1 to 1.5 mm can be used in the iron and steel industry, and particles having a size within the range from 2 to 3 mm can be used for forming alloys with aluminum.

In accordance with the process of the present invention, rotund salt-coated metal particles can be produced having a particle size within the range from 0.1 to 3.0 mm. These rotund salt-coated metal particles preferably contain from 1 to 25% by weight of the salt coating, more preferably from 2 to 15% by weight of the salt coating.

The present invention is described in more detail in connection with the following Example.

EXAMPLE

Substantially pure magnesium and magnesium alloy AZ31 (about 3% aluminum and about 1% zinc, with the rest, i.e. 96%, being essentially magnesium) were used, as the molten metal to be dispersed in the salt melt. Tests were conducted with a salt melt consisting of about 50 mole % of sodium chloride and about 50 mole % of potassium chloride, i.e. a substantially equimolar mixture of these salts.

The mixture of the salts was melted in a melting crucible having a capacity of 20 kg. The separately melted metal was added to the salt melt in the crucible. After stirring at various temperatures and stirrer speeds shown below in Table 1, the resulting dispersion of the molten metal in the salt melt was cooled by casting the dispersion in shallow molds. Representative samples of the solidified (frozen) dispersion were taken for visual evaluation of the dispersion and the form of the particles. The samples were thereafter ground in a Turbomill, and the salt particles and rotund salt-coated metal particles were separated from each other and sieve-analyzed. The salt coating on the metal particles amounted to from 10 to 15% by weight.

TABLE 1

| Test No. | Metal type | Temp. (°C.) | Ratio metal/salt (weight-%) | Stirrer type | Tip speed of stirrer (m/min) | Dispersion time (min) | Note |
|---|---|---|---|---|---|---|---|
| | | | Test Parameters and Results | | | | |
| 1 | Pure Mg | 670 | 60/40 | T | 157 | 10 | Good dispersion |
| 2 | " | 670 | 60/40 | T | 157 | 5 | Good dispersion |
| 3 | " | 700 | 50/50 | T | 251 | 3 | Good dispersion |
| 4 | " | 700 | 66/34 | T | 251 | 5 | No dispersion |
| 5 | " | 700 | 40/60 | T | 126 | 1 | Good dispersion |
| 6 | " | 700 | 40/60 | T | 188 | 1 | Good dispersion |
| 7 | " | 700 | 40/60 | T | 251 | 1 | Good dispersion |
| 8 | " | 700 | 40/60 | B | 157 | 5 | Good dispersion |
| 9 | " | 700 | 60/40 | B | 157 | 5 | Good dispersion |
| 10 | " | 670 | 40/60 | P | 251 | 5 | No dispersion |
| 11 | " | 700 | 40/60 | P | 251 | 10 | No dispersion |
| 12 | " | 670 | 40/60 | T | 220 | 1 | Good dispersion |
| 13 | AZ31 | 670 | 50/50 | T | 157 | 10 | Good dispersion |
| 14 | " | 670 | 50/50 | T | 157 | 15 | Good dispersion |
| 15 | Pure Mg | 670 | 50/50 | T | 188 | 3 | Good dispersion |
| 16 | " | 800 | 50/50 | T | 235 | 0.25 | Good dispersion |
| 17 | " | 730 | 50/50 | T | 235 | 0.50 | Good dispersion |

Type of stirring device:
T = turbine stirrer
B = stirrer with 4 straight blades
P = stirrer with 3 propeller-shaped blades
Type of metal:
AZ31 = Mg—alloy with 3% Al and 1% Zn The sieve-analysis results are shown in Table 2 below, wherein the values represent the % by weight of the fractions at the indicated grain size.

TABLE 2

| Test No. | >2.0 | 2.0–1.6 | 1.59–1.0 | 0.99–0.8 | 0.79–0.5 | 0.49–0.2 | 0.19–0.1 | <0.1 (salt) |
|---|---|---|---|---|---|---|---|---|
| | Grain size in mm | | | | | | | |
| 1 | 2.5 | 11.5 | 15.0 | 9.0 | 8.0 | 8.0 | 4.0 | 42.0 |
| 2 | 37.0 | 14.0 | 16.5 | 5.0 | 6.0 | 9.0 | 7.0 | 5.5 |
| 3 | 0 | 2.0 | 11.0 | 42.0 | 9.0 | 32.0 | 2.0 | 2.0 |
| 5 | 22.0 | 6.0 | 3.5 | 1.0 | 2.5 | 8.5 | 16.0 | 40.5 |
| 6 | 1.0 | 8.0 | 0.5 | 22.0 | 10.0 | 22.0 | 17.0 | 19.5 |
| 7 | 0 | 0 | 0 | 0.5 | 23.0 | 31.0 | 12.0 | 33.5 |
| 8 | 1.0 | 1.0 | 10.5 | 22.5 | 5.5 | 14.0 | 24.5 | 21.0 |
| 9 | 7.5 | 12.5 | 25.0 | 10.5 | 7.5 | 12.5 | 9.5 | 15.0 |
| 12 | 0 | 0 | 0 | 4.0 | 28.0 | 19.5 | 13.0 | 35.5 |
| 13 | 12.0 | 12.0 | 5.0 | 20.0 | 1.5 | 15.5 | 13.5 | 20.5 |
| 14 | 2.0 | 3.0 | 9.5 | 18.5 | 16.0 | 17.0 | 15.0 | 19.0 |
| 16 | 0 | 0.5 | 0.5 | 13.0 | 34.0 | 23.0 | 8.0 | 21.5 |

As apparent from these results, the particle size is controlled by the stirrer speed and the time during which stirring is conducted (Tests 1–3). The dispersion proceeds without any difficulty, until the dispersion contains more than 60% by weight of the molten metal (Test 4), at which no dispersion is formed, even at a high stirring speed and a relatively long stirring time. Furthermore, no dispersion is formed when a stirrer having 3 propeller-shaped blades is used (Tests 10 and 11).

At higher temperatures, substantially over 700° C., there is a tendency for the metal to oxidize on its surface during casting of the dispersion. Therefore, the maximum temperature at which the dispersion is formed is 730° C., preferably 710° C.

The stability of the dispersion was examined during Test No. 15. The dispersion was held at 700° C. for a period of 20 hours. A total of 8 samples were taken over this period. These samples were cooled, and ground in a Turbomill and sieve-analyzed. Even after 20 hours holding time, there was no tendency of the metal particles to coalesce. The results are shown below in Table 3, in which the values represent the % by weight of the fractions at the indicated grain size.

TABLE 3

| Test No. | Grain size in mm >2.0 | 2.0–1.0 | 0.99–0.8 | 0.79–0.4 | 0.39–0.2 | <0.2 (salt) | Holding time at sampling (hours) |
|---|---|---|---|---|---|---|---|
| 1 | 0 | 2.0 | 12.5 | 35.5 | 14.5 | 35.5 | 0 |
| 2 | 0 | 3.5 | 6.0 | 33.5 | 15.0 | 42.0 | 0.5 |
| 3 | 0 | 0 | 12.0 | 34.0 | 14.0 | 40.0 | 1.0 |
| 4 | 0 | 2.5 | 11.0 | 37.0 | 13.0 | 36.5 | 1.5 |
| 5 | 0 | 0.5 | 15.0 | 36.5 | 14.0 | 34.0 | 2.0 |
| 6 | 0 | 3.5 | 9.0 | 33.5 | 13.5 | 40.5 | 2.5 |
| 7 | 0 | 7.0 | 7.5 | 38.0 | 15.0 | 42.5 | 4.0 |
| 8 | 0 | 5.5 | 9.5 | 32.0 | 13.0 | 40.0 | 20.0 |

I claim:

1. A process for preparing rotund particles of salt-coated magnesium or magnesium alloy, which comprises:

adding a molten metal selected from the group consisting of magnesium and a magnesium alloy to a substantially non-hygroscopic salt melt, having a viscosity of from 1.5 to 5.0 cps containing at least 50% by weight of at least one anhydrous alkali metal chloride, the density of said salt melt being substantially the same as the density of said molten metal;

stirring said molten metal and salt melt with a stirrer operating at a tip speed always below 450 meters per minute, at a temperature of from 660° to 730° C., to obtain a dispersion of said molten metal in said salt melt containing up to 60% by weight of said molten metal;

cooling said dispersion to solidify the molten metal and salt melt; and disintegrating the resultant solid product to obtain rotund particles of said salt-coated magnesium or magnesium alloy.

2. A process according to claim 1, wherein said salt melt contains from 40 to 50% by weight of sodium chloride and from 50 to 60% by weight of potassium chloride.

3. A process according to claim 1, wherein said salt melt contains substantially equimolar amounts of sodium chloride and potassium chloride, and has a density of from 1.575 to 1.61 g/cm$^3$ at a temperature of from 700° to 660° C.

4. A process according to claim 1, wherein said dispersion contains from 40 to 60% by weight of said molten metal.

5. A process according to claim 4, wherein said dispersion contains from 45 to 55% by weight of said molten metal.

6. A process according to claim 1, wherein said magnesium alloy is an alloy of magnesium with at least one member selected from the group consisting of aluminum and zinc.

7. A process according to claim 1, wherein said molten metal is substantially pure magnesium.

8. A process according to claim 1, wherein said molten metal is an alloy consisting essentially of about 97% by weight of magnesium, 3% by weight of aluminum and about 1% by weight of zinc.

9. A process according to claim 7 or 8, wherein said salt melt consists essentially of about 50 mole % of sodium chloride and about 50 mole % of potassium chloride.

10. A process according to claim 1, wherein the viscosity of said salt melt is from 1.6 to 3.0 cps.

11. A process according to claim 1, wherein said stirrer is operating at a tip speed below 400 meters per minute.

12. A process according to claim 1, wherein said temperature at which said stirring is conducted is from 660° to 710° C.

13. A process according to claim 12, wherein said temperature is from 690° to 710° C.

14. A process according to claim 1, wherein said stirring is conducted for from 0.5 to 20 minutes.

15. A process according to claim 14, wherein said stirring is conducted for from 1 to 15 minutes with a turbine stirrer operating at a tip speed of from 100 to 400 meters per minute.

16. A process according to claim 1, wherein said stirrer is a turbine stirrer or a straight-blade stirrer.

17. A process according to claim 1, wherein the particle size of said rotund particles is from 0.1 to 3.0 mm.

18. A process according to claim 1, wherein said rotund particles contain from 1 to 25% by weight of the salt coating.

19. A process according to claim 18, wherein said rotund particles contain from 2 to 15% by weight of the salt coating.

20. A process according to claim 1, wherein said dispersion does not contain a surface-stabilizing agent and does not contain a surface-active agent.

21. A process according to claim 20, wherein said dispersion contains from 45 to 60% by weight of said molten metal.

* * * * *